US011525447B2

(12) United States Patent
Horng et al.

(10) Patent No.: US 11,525,447 B2
(45) Date of Patent: Dec. 13, 2022

(54) SLIM PUMP

(71) Applicant: Sunonwealth Electric Machine Industry Co., Ltd., Kaohsiung (TW)

(72) Inventors: Alex Horng, Kaohsiung (TW); Tso-Kuo Yin, Kaohsiung (TW); Ming-Tsung Li, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 121 days.

(21) Appl. No.: 17/071,158

(22) Filed: Oct. 15, 2020

(65) Prior Publication Data

US 2021/0301826 A1 Sep. 30, 2021

(30) Foreign Application Priority Data

Mar. 31, 2020 (TW) ..... 109111019

(51) Int. Cl.
*F04D 13/06* (2006.01)
*F04D 29/42* (2006.01)

(52) U.S. Cl.
CPC ..... *F04D 13/06* (2013.01); *F04D 29/42* (2013.01); *F04D 29/426* (2013.01); *F04D 29/4293* (2013.01)

(58) Field of Classification Search
CPC .. F04D 13/06; F04D 13/0653; F04D 13/0673; F04D 13/0666; F04D 13/0667; F04D 17/165; F04D 29/167; F04D 29/225; F04D 29/285; F04D 29/326; F04D 29/42; F04D 29/426; F04D 29/4273; F04D 29/4293; F04D 29/445; F04D 29/447
USPC ..... 416/186 R
See application file for complete search history.

(56) References Cited

U.S. PATENT DOCUMENTS

| | | | | |
|---|---|---|---|---|
| 1,873,974 | A * | 8/1932 | Meyer | F04D 29/284 416/186 R |
| 9,388,811 | B2 * | 7/2016 | Tang | F04D 13/08 |
| 2010/0037458 | A1 * | 2/2010 | Ranz | F04D 29/284 29/889 |
| 2019/0368495 | A1 * | 12/2019 | Matsui | H02K 9/19 |

FOREIGN PATENT DOCUMENTS

| | | |
|---|---|---|
| JP | 2009008055 A | 1/2009 |
| TW | M305266 | 1/2007 |
| TW | M574186 U | 2/2019 |
| TW | I685617 B | 2/2020 |

* cited by examiner

*Primary Examiner* — Kenneth J Hansen
(74) *Attorney, Agent, or Firm* — Alan D. Kamrath; Karin L. Williams; Mayer & Williams PC

(57) ABSTRACT

A slim pump according to the present invention includes a frame, a shaft-coupling portion, a stator, and an impeller. The frame includes an interior separated by a partitioning board into a first chamber and a second chamber. A flow inlet intercommunicates with the first chamber and a flow outlet intercommunicates with the second chamber. The first chamber is intercommunicated with the second chamber via a communication hole of the partitioning board. The shaft-coupling portion is located in the frame. The stator is disposed around the shaft-coupling portion and is located within an axial extent of the first chamber. The stator is axially aligned with the communication hole. The impeller includes a plurality of blades and an inlet opening located in the second chamber. The inlet opening faces and axially aligns with the communication hole.

22 Claims, 19 Drawing Sheets

SLIM PUMP

CROSS REFERENCE TO RELATED APPLICATION

The application claims the benefit of Taiwan application serial No. 109111019, filed on Mar. 31, 2020, and the entire contents of which are incorporated herein by reference.

BACKGROUND OF THE INVENTION

1. Field of the Invention

The present invention relates to a pump and, more particularly, to a slim pump capable of driving a working fluid to flow.

2. Description of the Related Art

Early pumps mostly receive a working fluid from an axial pipe, and the working fluid is guided by an impeller to exit in a lateral direction. However, this flow guiding approach results in difficulties in reduction of the axial height of the pump. In this regard, slim pumps have been developed in the industry recently by inputting and outputting the working fluid both in the lateral direction. For example, FIG. 1 shows a conventional slim pump 9 including a housing 91, a rotor unit 92, and a stator unit 93. The housing 91 includes a seat 911 and a lid 912 coupled to a top end of the seat 911. A flow guiding space 913 is formed between an interior of the seat 911 and the lid 912. The housing 91 further includes a flow inlet 914 and a flow outlet, which intercommunicate with the flow guiding space 913 in a lateral direction. The flow inlet 914 and the flow outlet are approximately aligned with an upper portion of the flow guiding space 913. A shaft-coupling portion 915 is disposed in a lower portion of the flow guiding space 913. The rotor unit 92 is located in the flow guiding space 913 and includes a hub 921 rotatably mounted to the shaft-coupling portion 915, a plurality of blades 922 coupled to the hub 921 and located in the upper portion of the flow guiding space 913, and a magnet ring 923 coupled to the hub 921 and located in the lower portion of the flow guiding space 913. The stator unit 93 is coupled to a lower portion of the seat 911 and is located outside of the flow guiding space 913. Furthermore, the stator unit 93 is radially aligned with the magnet ring 923 and is separated from the magnet ring 923 by the seat 911. An example of such a conventional slim pump 9 is disclosed in Taiwan Utility Model No. M305266.

However, during operation of the above-mentioned conventional slim pump 9, the stator unit 93 can drive the hub 921 to rotate, such that the working fluid can flow through the flow inlet 914 into the flow guiding space 913, and is then guided to exit via the flow outlet. However, since both the flow inlet 914 and the flow outlet are aligned with the upper portion of the flow guiding space 913, after the working fluid has been guided into the upper portion of the flow guiding space 913, a portion of the working fluid flows downwards into the lower portion of the flow guiding space 913 and disturbs the subsequent incoming and outgoing flows, adversely affecting the smoothness of discharge of the working fluid via the flow outlet. Thus, although the conventional slim pump 9 can have a reduced axial height, the fluid supply amount of the pump is reduced.

In light of this, it is necessary to improve the conventional slim pumps.

SUMMARY OF THE INVENTION

To solve the above disadvantages, it is an objective of the present invention to provide a slim pump capable of effectively using an interior space in a frame for guiding purposes and providing a smooth flow guiding path to reduce mutual interference between the incoming flow and the outgoing flow, thereby achieving both effects of thinning and high fluid supply amount of the pump.

It is another objective of the present invention to provide a slim pump capable of further reducing the axial height of the whole pump and increasing the fluid supply amount through a simple structure.

It is a further objective of the present invention to provide a slim pump capable of guiding the working fluid to flow into and out of a side of the frame, and the impeller can guide the flow in a pattern of axial input and lateral output in the frame.

It is yet another objective of the present invention to provide a slim pump including an impeller that can pressurize the working fluid while the working fluid is flowing into spaces between blades.

As used herein, the term "a" or "an" for describing the number of the elements and members of the present invention is used for convenience, provides the general meaning of the scope of the present invention, and should be interpreted to include one or at least one. Furthermore, unless explicitly indicated otherwise, the concept of a single component also includes the case of plural components.

As used herein, the term "coupling", "engagement", "assembly", or similar terms is used to include separation of connected members without destroying the members after connection or inseparable connection of the members after connection. A person having ordinary skill in the art would be able to select according to desired demands in the material or assembly of the members to be connected.

A slim pump according to the present invention includes a frame, a shaft-coupling portion, a stator, and an impeller. The frame includes an interior separated by a partitioning board into a first chamber and a second chamber. A flow inlet intercommunicates with the first chamber and a flow outlet intercommunicates with the second chamber. The first chamber is intercommunicated with the second chamber via a communication hole of the partitioning board. The shaft-coupling portion is located in the frame. The stator is disposed around the shaft-coupling portion and is located within an axial extent of the first chamber. The stator is axially aligned with the communication hole. The impeller includes a plurality of blades and an inlet opening located in the second chamber. The inlet opening faces and axially aligns with the communication hole in an axial direction. The communication hole is located between the impeller and the stator in the axial direction.

Thus, due to the configuration of the partitioning board and the impeller in the slim pump according to the present invention, the working fluid guided from the outside can fully utilize the remaining space in the first chamber for flow guiding purposes. Furthermore, when flowing into the second chamber, the working fluid can pass through the inlet opening and is, thus, guided into the spaces between the plurality of blades and is then smoothly discharged under guidance of the impeller. Thus, the slim pump according to the present invention can fully utilize the space in the frame for guiding the working fluid and can assure the working fluid to flow smoothly under guidance, reducing mutual interference between the incoming flow and the outgoing flow. Thus, an expected flow volume and an expected lift can be achieved even under a condition of a limited dimension of the slim pump.

In an example, the impeller includes a shaft rotatably coupled to the shaft-coupling portion. The shaft is connected to a hub. A top disc is connected to blade top edges of the plurality of blades and the hub. An annular member is connected to blade bottom edges of the plurality of blade. The inlet opening is formed between an annular inner edge of the annular member and the hub. Thus, the top disc can cover the top ends of the plurality of blades, and the annular member provides a pressurizing effect for the working fluid, increasing the flow guiding efficiency.

In an example, the communication hole is axially aligned within a diametric extent of the annular inner edge of the annular member. Thus, the disposition of the annular member will not adversely affect the smoothness of the working fluid passing through the inlet opening, increasing the flow guiding efficiency.

In an example, the top disc includes a disc outer edge, and the annular member has an annular outer edge. The disc outer edge of the top disc and the annular outer edge of the annular member are flush with blade outer edges of the plurality of blades. Thus, the structural strength of the impeller is increased.

In an example, the impeller includes a magnetic member coupled to the hub and disposed around the shaft-coupling portion, and the magnetic member is radially or axially aligned with the stator. Thus, the magnetic member can be connected to the hub to simplify the structure of the hub, increasing the assembly convenience and permitting use of stators of different types.

In an example, the frame includes a backstop disposed around the communication hole. The backstop is located between the partitioning board and the annular member. Thus, the working fluid cannot easily flow through a narrow slit between the backstop and the annular member to the outer periphery of the impeller, improving the flow guiding smoothness and the flow guiding efficiency.

In an example, the backstop is contiguous to an inner periphery of the communication hole. Thus, the backstop also provides a flow guiding function to guide the working fluid to flow towards the inlet opening of the impeller, improving the flow guiding smoothness and the flow guiding efficiency.

In an example, the slim pump further comprises a guiding unit coupled to the impeller to rotate therewith. The guiding unit includes a plurality of auxiliary flow guiding members disposed around the shaft-coupling portion. Each two adjacent auxiliary flow guiding members form a passageway therebetween. The plurality of auxiliary flow guiding members is located within a diametric extent of the communication hole. Thus, the plurality of auxiliary flow guiding members can increase the pressure of the working fluid flowing into the impeller, improving the flow guiding smoothness and the flow guiding efficiency.

In an example, the guiding unit includes a disc seat connected to the hub and an inner edge of each of the plurality of auxiliary flow guiding members. Thus, by coupling the disc seat to the hub, the plurality of auxiliary flow guiding members can be accurately positioned relative to other components, increasing the assembly convenience and efficiency.

In an example, the disc seat includes a coupling portion and a sleeve connected to the coupling portion. The coupling portion is connected to the hub. The sleeve is located around the shaft-coupling portion. The inner edges of the plurality of auxiliary flow guiding members are connected to the sleeve. The inlet opening is located between the plurality of blades and the plurality of auxiliary flow guiding members. Thus, the disc seat has a simple structure to reduce the manufacturing costs and to increase the assembly convenience.

In an example, the plurality of auxiliary flow guiding members extends radially beyond the hub, and an outer edge of each of the plurality of auxiliary flow guiding members is axially aligned with the inlet opening. Thus, the plurality of auxiliary flow guiding members can rotate smoothly without interfering with other components. Furthermore, the plurality of auxiliary flow guiding members provides a better pressurizing effect for the working flow to improve the flow guiding smoothness and the flow guiding efficiency.

In an example, the number of the plurality of auxiliary flow guiding members is greater than the number of the plurality of blades. Thus, the plurality of auxiliary flow guiding members increases the pressure for guiding the working fluid to flow upwards into the second chamber, and the number of the plurality of blades is lesser to increase the discharging smoothness of the working fluid, improving the flow guiding smoothness and the flow guiding efficiency.

In an example, the shaft is coupled to a central disc of the hub. Each of the plurality of auxiliary flow guiding members has a top portion coupled to the central disc of the hub. Each of the plurality of auxiliary flow guiding members has a bottom portion extending into the first chamber. Thus, the guiding unit enables the working fluid to flow towards the plurality of blades in a centrifugal type flow-guiding pattern with axial input and lateral output, further increasing the pressurizing effect of the working fluid.

In an example, the guiding unit includes an extension seat connected to an outer edge of each of the plurality of auxiliary flow guiding members. A magnetic member is coupled to the extension seat and is axially or radially aligned with the stator. Thus, the magnetic member can be disposed on the guiding unit so as to be more adjacent to the stator, increasing the impeller driving efficiency and permitting use of stators of different types.

In an example, the first chamber is axially adjacent to the second chamber, and the flow inlet and the flow outlet are on a radial side of the frame. Thus, the working fluid can be guided into and out of the frame from a radial side of the frame, and the impeller in the frame can proceed with a flow guiding pattern with axial input and lateral output, reducing the overall axial height of the slim pump and increasing the fluid supply amount of the slim pump.

In an example, the stator is located in the first chamber, and the impeller is configured to drive an electrically non-conductive fluid to flow. Thus, both the impeller and the stator can be mounted in the frame without the need of isolation, and a short circuit would not occur during operation, increasing the impeller driving effect of the stator and effectively reducing the overall dimension of the slim pump.

In an example, one of poles of the stator is lacked to form a slot through which the working fluid flows. Thus, the resistance to the working fluid at the slot can be significantly reduced, and the working fluid can, therefore, flow more smoothly towards the second chamber, improving the flow guiding smoothness and the flow guiding efficiency.

In an example, the slot faces the flow inlet. Thus, the working fluid can pass through the slot to flow upward once flowing into the first chamber, reducing the energy loss resulting from impact of the working fluid to the stator, improving the flow guiding smoothness and the flow guiding efficiency.

In an example, the frame includes a body on which the partitioning board is disposed, a bottom board connected to the body, and a lid connected to the body. The first chamber is formed between the partitioning board and the bottom board. The second chamber is formed between the lid and the partitioning board. Thus, the frame has a simple structure and is easy to manufacture and assemble as well as easy thinning.

In an example, the bottom board includes an elevated portion located within the axial extent of the first chamber. The stator is received in the elevated portion and located outside of the frame. Thus, the stator does not contact with the working fluid in the frame, such that working fluids of any electrical conductivity can be used, reducing the costs of the working fluid.

In an example, the elevated portion is a C-shaped annulus with a gap in the first chamber to permit flow of a working fluid. One of poles of the stator is omitted and a portion of the stator where the pole is omitted is aligned with the gap. Thus, the resistance to the working fluid at the gap can be significantly reduced, and the working fluid can, therefore, flow more smoothly towards the second chamber, improving the flow guiding smoothness and the flow guiding efficiency.

In an example, the gap faces the flow inlet. Thus, the working fluid can pass through the gap to flow upward once flowing into the first chamber, reducing the energy loss resulting from impact of the working fluid to the elevated portion, improving the flow guiding smoothness and the flow guiding efficiency.

BRIEF DESCRIPTION OF THE DRAWINGS

The present invention will become clearer in light of the following detailed description of illustrative embodiments of this invention described in connection with the drawings.

Figure 1:
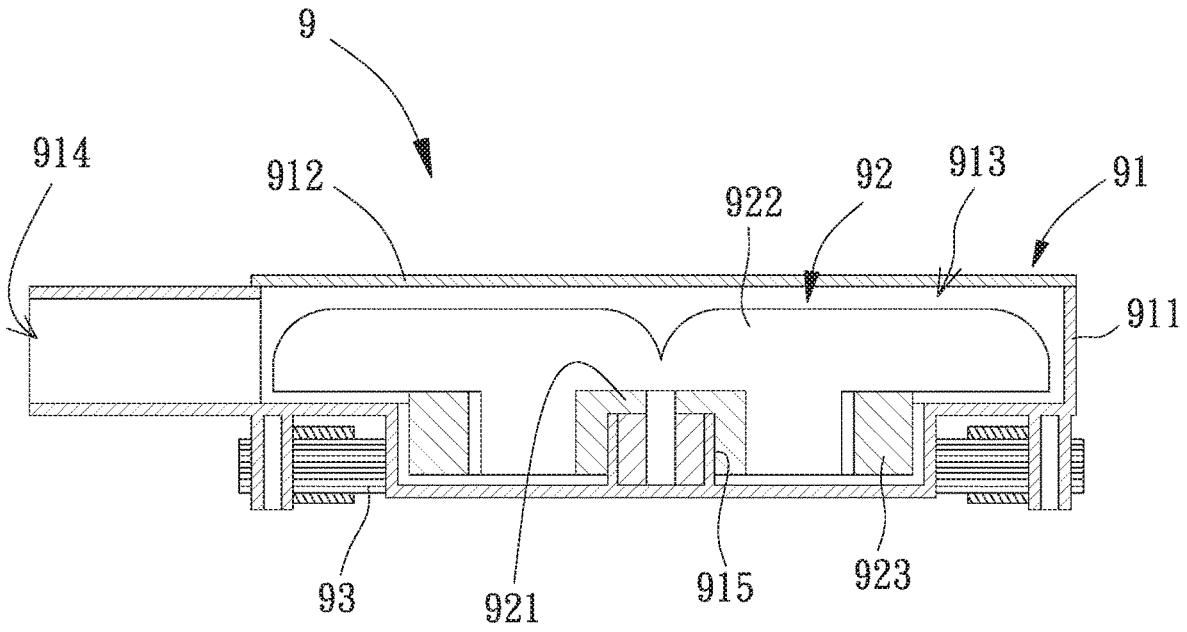
FIG. 1 PRIOR ART
FIG. 1 is a cross sectional view of a conventional slim pump.

When the terms "front", "rear", "left", "right", "up", "down", "top", "bottom", "inner", "outer", "side", and similar terms are used herein, it should be understood that these terms have reference only to the structure shown in the drawings as it would appear to a person viewing the drawings and are utilized only to facilitate describing the invention, rather than restricting the invention.

DETAILED DESCRIPTION OF THE INVENTION

Figure 2:
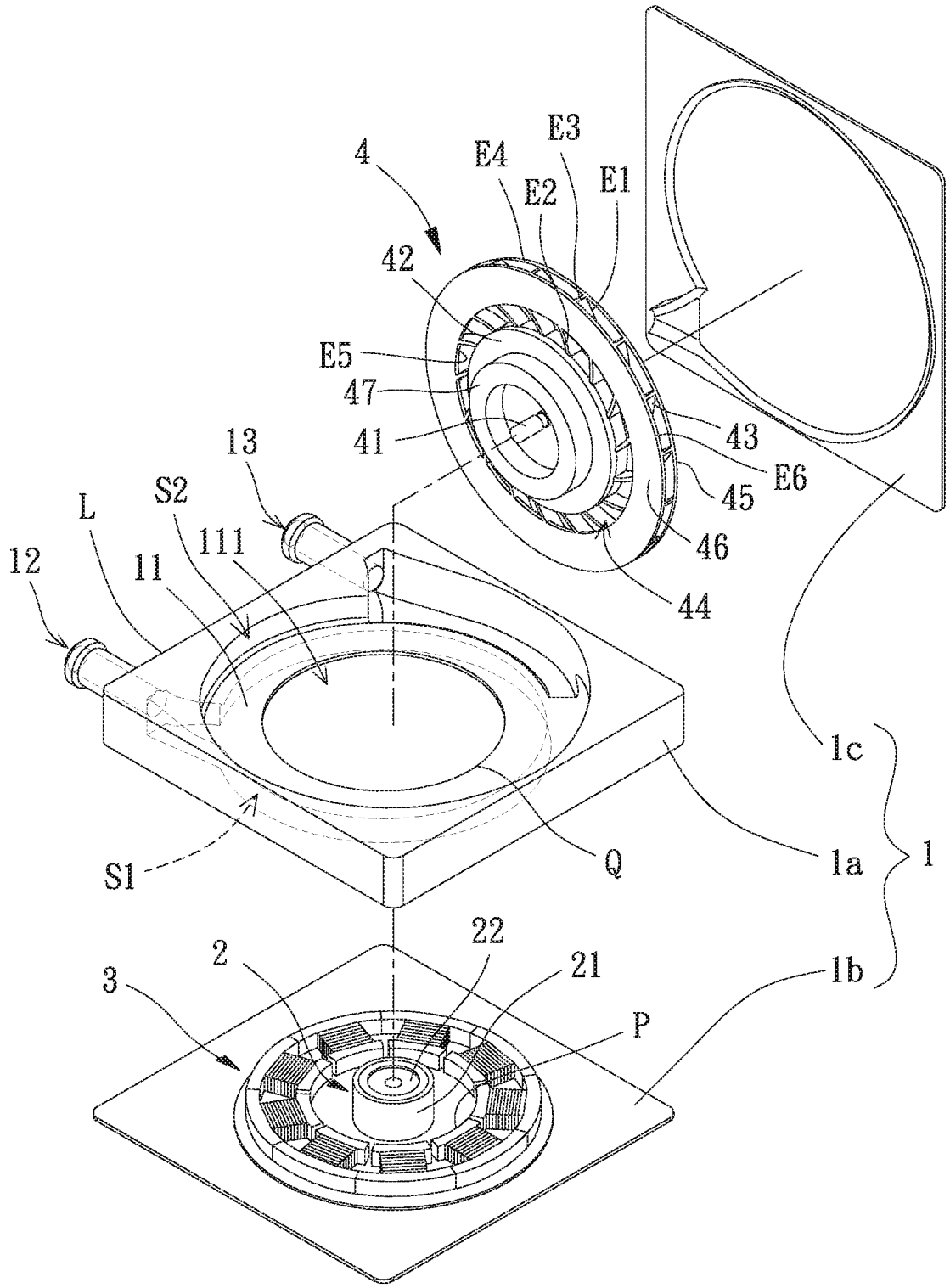
FIG. 2 is an exploded, perspective view of a slim pump of a first embodiment according to the present invention.

With reference to FIG. 2, a slim pump of a first embodiment according to the present invention includes a frame 1, a shaft-coupling portion 2, a stator 3, and an impeller 4. The shaft-coupling portion 2, the stator 3, and the impeller 4 are located in the frame 1.

Figure 4:
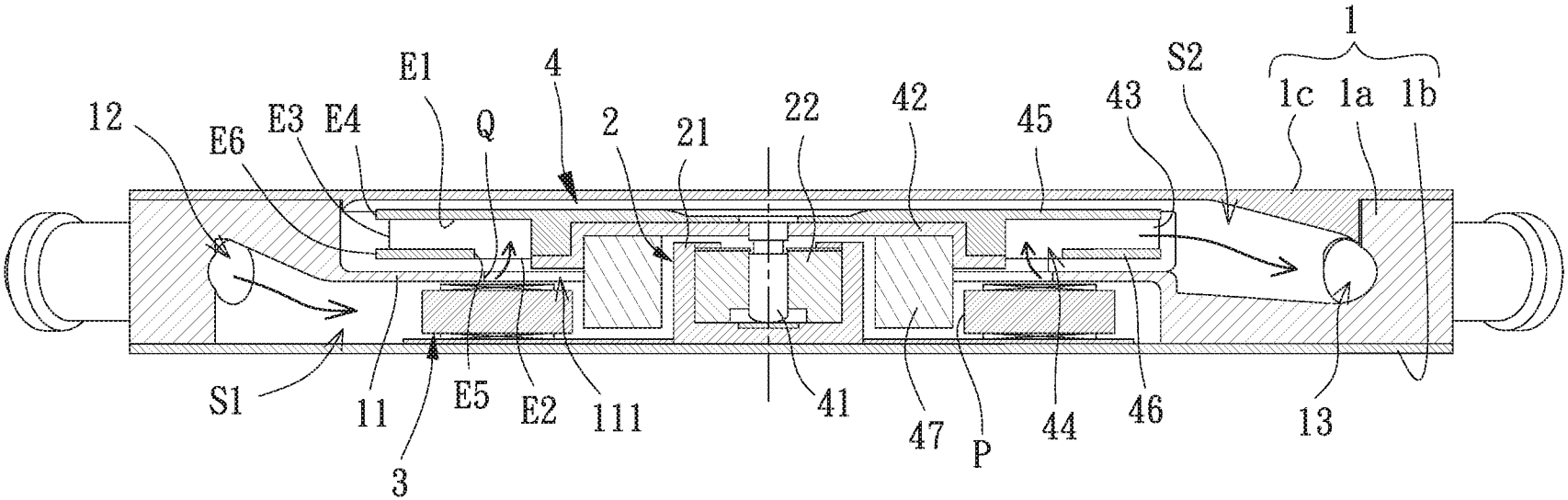
FIG. 4 is a cross sectional view taken along section line 4-4 of FIG. 3.

With reference to FIGS. 2 and 4, the frame 1 includes an interior separated by a partitioning board 11 into a first chamber S1 and a second chamber S2 adjacent to the first chamber S1 in an axial direction. A flow inlet 12 intercommunicates with the first chamber S1, and a flow outlet 13 intercommunicates with the second chamber S2. The first chamber S1 and the second chamber S2 can be adjacent to each other in the axial direction. Furthermore, the flow inlet 12 and the flow outlet 13 can be on a radial side L of the frame 1. The first chamber S1 is intercommunicated with the second chamber S2 via a communication hole 111 of the partitioning board 11. The type of the frame 1 is not limited in the present invention. In this embodiment, the frame 1 includes a body 1*a*, a bottom board 1*b*, and a lid 1*c*. The body 1*a* can be, but not limited to, a substantially rectangular cuboid. Furthermore, each of an upper face and a lower face of the body 1*a* is recessed to form a circular groove, and the partitioning board 11 is annular and located between the two circular grooves. Two guiding tubes are disposed on a sidewall of the body 1*a*, and the flow inlet 12 and the flow outlet 13 are respectively disposed on the two guiding tubes. When the bottom board 1*b* and the lid 1*c* are coupled to the lower and upper faces of the body 1*a*, respectively, the circular groove between the bottom board 1*b* and the partitioning board 11 forms the first chamber S1, and the circular groove between the lid 1*c* and the partitioning board 11 forms the second chamber S2.

The shaft-coupling portion 2 is located in the frame 1 and generally includes a shaft tube 21 and at least one bearing 22. The shaft tube 21 is coupled to the frame 1 and can extend from the first chamber S1 towards the second chamber S2. The at least one bearing 22 is located in the shaft tube 21 for supporting rotational movement of the impeller 4. The coupling mechanism of the shaft-coupling portion 2 and the frame 1 and the internal components of the shaft-coupling portion 2 can be varied according to needs, which can be appreciated by one having ordinary skill in the art and, thus, should not be limited to the type disclosed in this embodiment illustrated in the figures. In this embodiment, the shaft tube 21 can be coupled to the bottom board 1*b* and can extend towards the second chamber S2 and through the communication hole 111. Furthermore, the at least one bearing 22 provides a sufficient depth for installing the impeller 4, such that the impeller 4 can rotate stably relative to the frame 1.

The stator 3 is disposed around the shaft-coupling portion 2 and is located within an axial extent of the first chamber S1. Thus, the stator 3 generally neither protrudes outward relative to the frame 1 nor extends into the second chamber S2. This avoids an increase in the overall axial height of the slim pump or an adverse effect on the working fluid in the second chamber S2. Specifically, when the working fluid driven by the slim pump is a gas or an electrically nonconductive fluid, the stator 3 can be disposed in the first chamber S1 without being enveloped by an extra waterproof material, as shown in the figures of the current embodiment. Alternatively, as shown in an embodiment illustrated in FIG. 7, the bottom board 1*b* can include an elevated portion 14 which can be a continuous groove or a plurality of spaced grooves protruding towards the partitioning board 11. Furthermore, the elevated portion 14 is located within the axial extent of the first chamber S1, such that the stator 3 can be mounted into the elevated portion 14 from an outside of the frame 1 without contacting with the working fluid in the frame 1. Therefore, the electrical conductivity of the working fluid is not limited.

Figure 3:
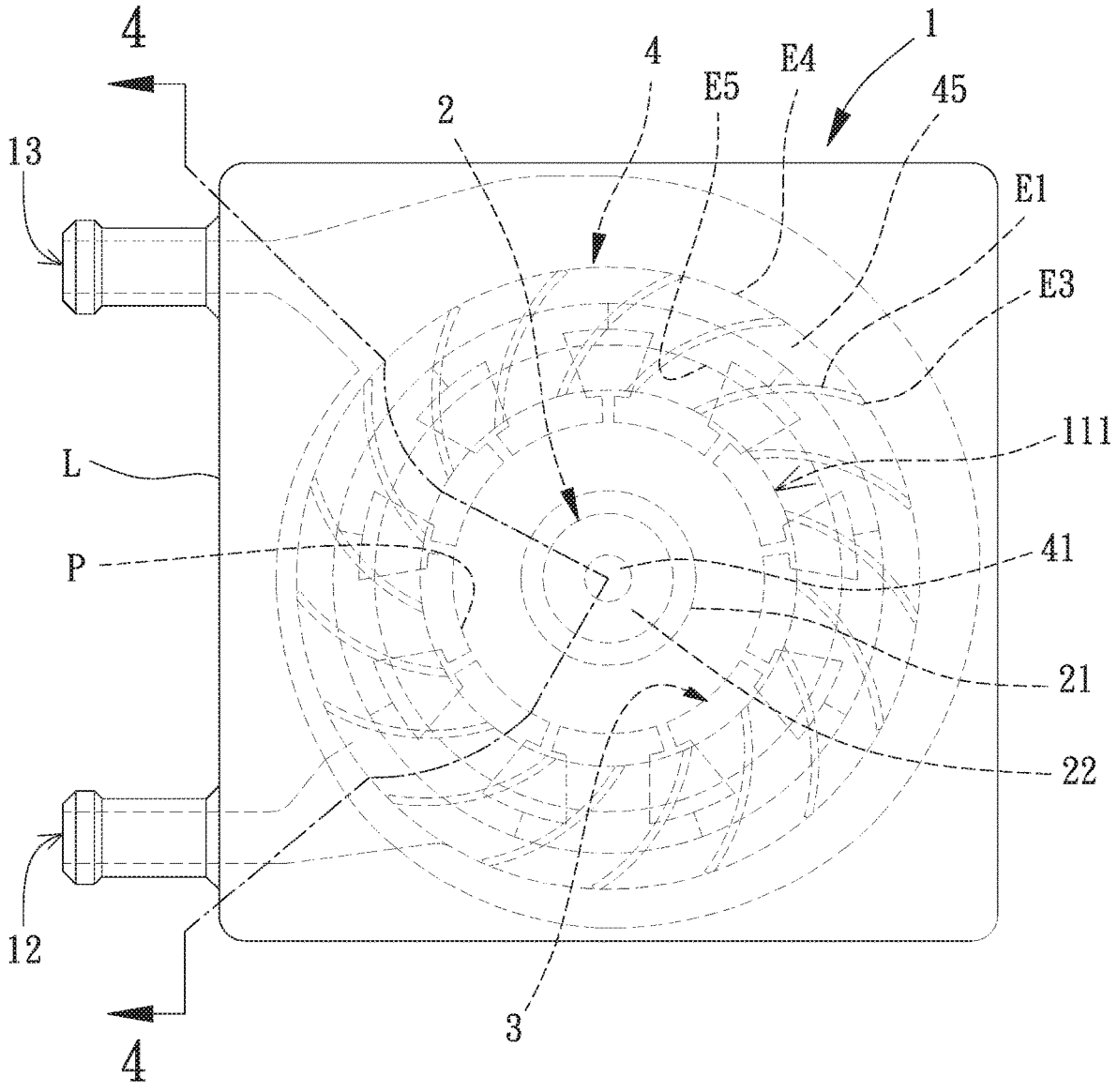
FIG. 3 is a top view of the slim pump of the first embodiment according to the present invention.

With reference to FIGS. 3 and 4, the stator 3 can be axially aligned with the communication hole 111, such that the working fluid in the first chamber S1 can flow through gaps in the stator 3 into the second chamber S2. Furthermore, the type of the stator 3 is not limited in the present invention. In this embodiment, the stator 3 can include a plurality of annularly arranged poles formed by stacking silicon steel plates, and coils can be radially wound around the plurality of annularly arranged poles. The stator 3 can be axially aligned with the communication hole 111 at a portion thereof which is more adjacent to an inner edge of the stator 3.

With reference to FIGS. 2 and 4, the impeller 4 includes a shaft 41. An end of the shaft 41 extends into the shaft tube 21 of the shaft-coupling portion 2 and is rotatably received in the at least one bearing 22 of the shaft-coupling portion 2. Another end of the shaft 41 protrudes beyond the shaft tube 21 and can be connected to a hub 42. The impeller 4 further includes a plurality of blades 43 and an inlet opening 44 both located in the second chamber S2. The plurality of blades 43 is disposed around the shaft 41. The inlet opening 44 is located between the plurality of blades 43 and the communication hole 111. The inlet opening 44 faces and axially aligns with the communication hole 111, such that most of the working fluid flowing from the first chamber S1 into the second chamber S2 can directly flow through the inlet opening 44 into spaces between the plurality of blades 43 so as to be guided by the plurality of blades 43 to exit the second chamber S2. Each of the plurality of blades 43 includes a blade top edge E1, a blade bottom edge E2, and a blade outer edge E3 interconnected between the blade top edge E1 and the blade bottom edge E2.

In this embodiment, the impeller 4 further includes a top disc 45 and an annular member 46. The top disc 45 has a disc outer edge E4. The annular member 46 has an annular inner edger E5 and an annular outer edge E6. The top disc 45 is connected to the blade top edges E1 of the plurality of blades 43 and the hub 42. The annular member 46 is connected to the blade bottom edges E2 of the plurality of blades 43, such that the top disc 45 covers top ends of the plurality of blades 43. Furthermore, the inlet opening 44 is formed between the annular inner edge E5 of the annular member 46 and the hub 42. Thus, the working fluid can be pressurized by the annular member 46, flow axially into the inlet opening 44, and flow laterally outwards from the blade outer edges E3 of the plurality of blades 43, thereby being smoothly guided towards the flow outlet 13. For example, but not limited to, the plurality of blades 43, the top disc 45, and the annular member 46 can be integrally formed for easy manufacture and assembly whereas the plurality of blades 43 are less likely to deform during operation. The communication hole 111 can be axially aligned within the diametric extent of the annular inner edge E5 of the annular member 46, such that the annular member 46 will not adversely affect the smoothness of the working fluid passing through the inlet opening 44. The disc outer edge E4 of the top disc 45 and the annular outer edge E6 of the annular member 46 can be flush with the blade outer edges E3 of the plurality of blades 43, providing a stable structure for the impeller 4. The impeller 4 can further include a magnetic member 47 coupled to the hub 42 and disposed around the shaft-coupling portion 2. In this embodiment, the magnetic member 47 is located between the shaft-coupling portion 2 and the stator 3, and is radially aligned with the stator 3, such that the magnetic field generated after energizing the stator 3 is magnetically repulsive to the magnetism of the magnetic member 47, thereby driving the hub 42 and the plurality of blades 43 to rotate synchronously.

With reference to FIG. 4, according to the above-mentioned structure, during operation of the slim pump according to the present invention, rotation of the impeller 4 drives the working fluid in the second chamber S2 to exit via the flow outlet 13, forming a negative pressure in the second chamber S2 for guiding the external fluid to pass through the flow inlet 12 into the first chamber S1 of the frame 1. By the configuration of the partitioning board 11 and the impeller 4, the working fluid guided from the outside can be effectively guided through the remaining space in the first chamber S1 to pass through the gap between the stator 3 and the partitioning board 11, the gaps between the poles P of the stator 3, and the air gap between the stator 3 and the magnetic member 47. Then, the working fluid flows from the communication hole 111 into the second chamber S2, and is guided into the spaces between the plurality of blades 43 through the inlet opening 44, while the plurality of blades 43 guides the working fluid to smoothly exit the second chamber S2. Thus, in the slim pump of this embodiment, although the working fluid is guided into and out of the frame 1 via the radial side L of the frame 1, the impeller 4 located in the frame 1 guides the flow in a pattern of axial input and lateral output. Furthermore, with the partitioning board 11, mutual interference between the incoming working fluid and the outgoing working fluid can be avoided. Furthermore, the space in the frame 1 is effectively utilized to guide the working fluid. Thus, an expected flow volume and an expected lift can be achieved even under a condition that the size of the slim pump is limited.

Figure 5:
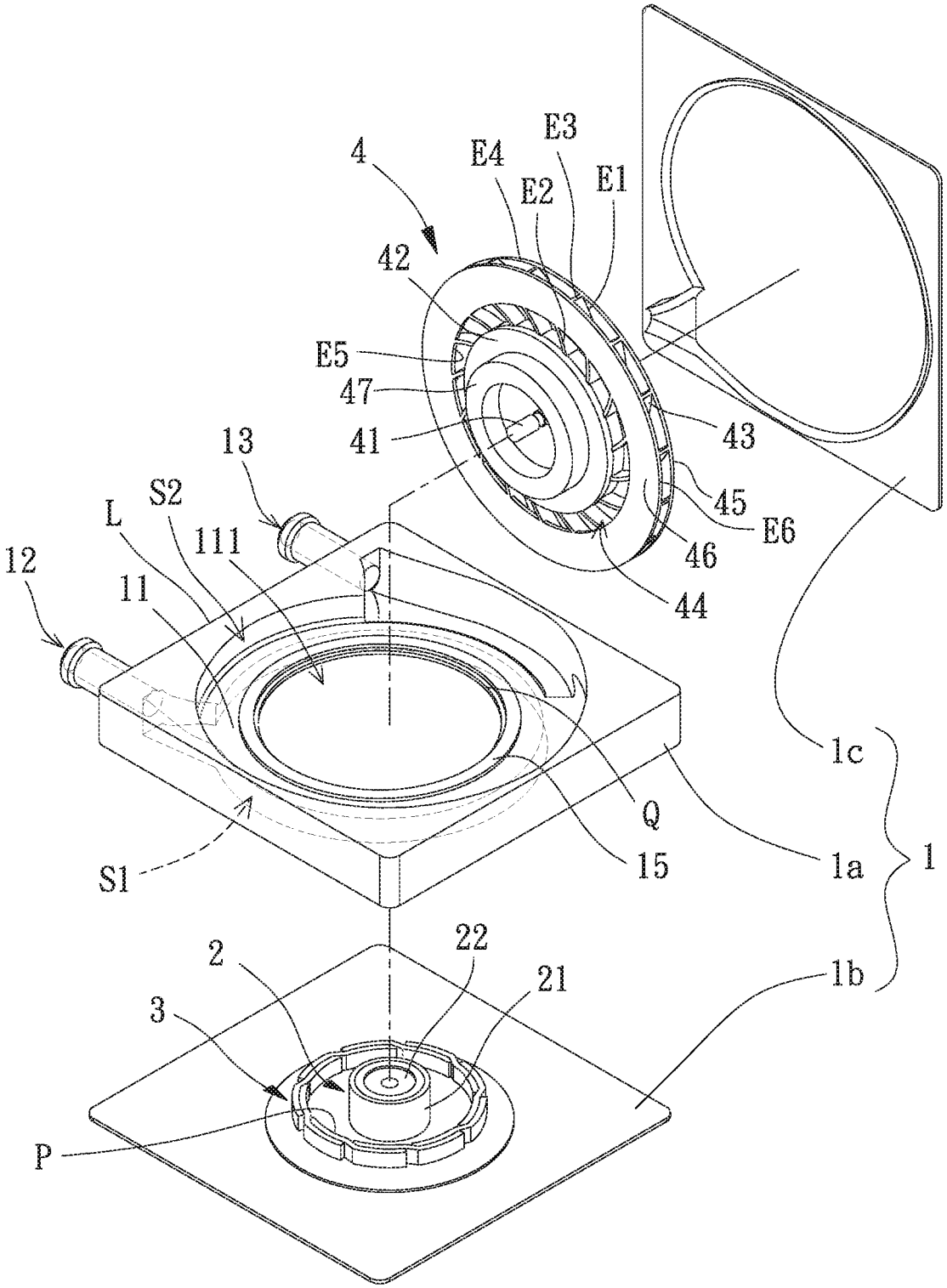
FIG. 5 is an exploded, perspective view of a slim pump of a second embodiment according to the present invention.
Figure 6:
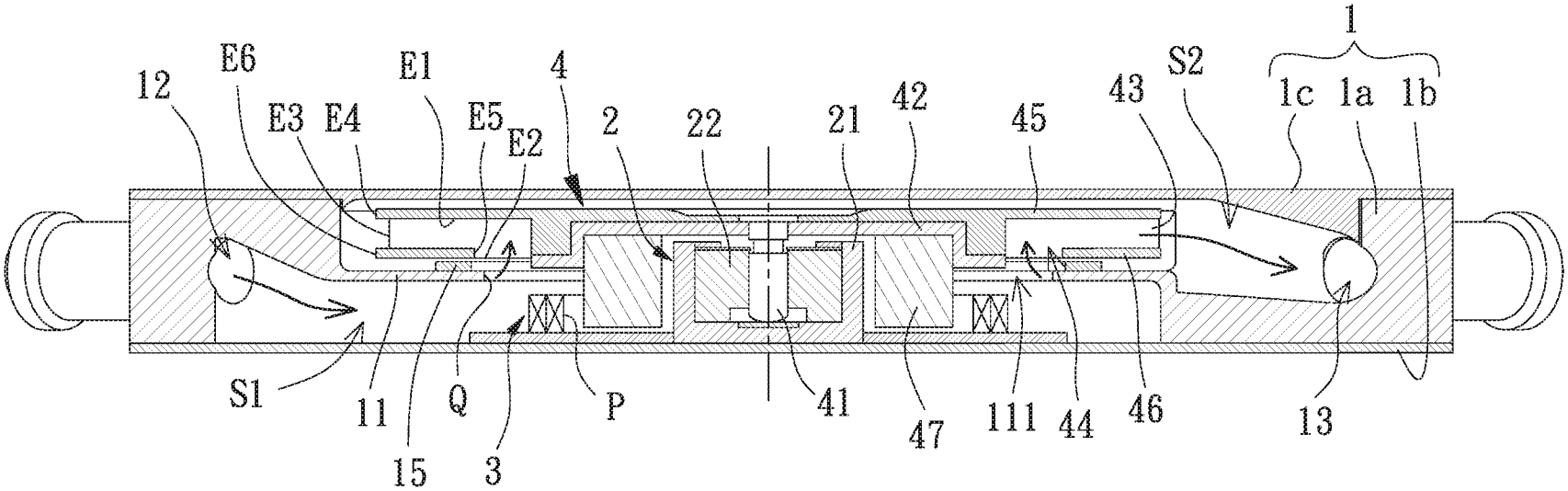
FIG. 6 is a cross sectional view of the slim pump of the second embodiment according to the present invention.

With reference to FIGS. 5 and 6, which show a slim pump of a second embodiment according to the present invention, the frame 1 of this embodiment can further include a backstop 15 disposed around the communication hole 111 without blocking or covering the communication hole 111. The backstop 15 can be located between the partitioning board 11 and the annular member 46, making that a slit between the backstop 15 and the annular member 46 narrow while not making the annular member 46 contacting the backstop 15 during rotation. Accordingly, the working fluid flowing from the first chamber S1 into the second chamber S2 cannot easily flow through the narrow slit between the backstop 15 and the annular member 46 to the outer periphery of the impeller 4, such that most working fluid can pass through the inlet opening 44 into the spaces between the plurality of blades 43. The backstop 15 can, for example, but not limited to, be a ring and can be coupled to or integrally formed with a face of the partitioning board 11 facing the annular member 46. In this embodiment, the stator 3 can, for example, be formed by winding coils around a bobbin. Since the stator 3 has a small radial width, the whole stator 3 can be axially located within the diametric extent of the communication hole 111 or even almost axially located within the diametric extent of the hub 42, such that a larger quantity of working fluid can, before passing through the gaps between the poles P of the stator 3, flow upwards through the communication hole 111 and the inlet opening 44 into the spaces between the plurality of blades 43, which is helpful in increasing the flowing smoothness of the working fluid.

Figure 7:
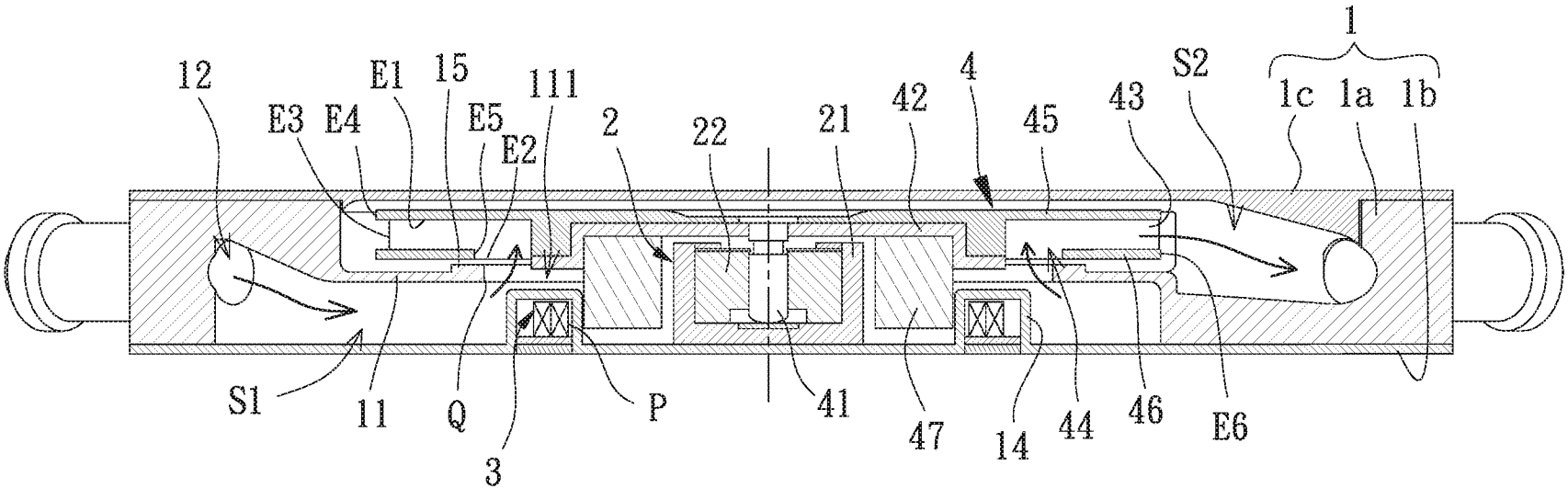
FIG. 7 is a cross sectional view of a slim pump of a third embodiment according to the present invention.

With reference to FIG. 7, which shows a slim pump of a third embodiment according to the present invention, the frame 1 of this embodiment includes the above-mentioned elevated portion 14 for receiving the stator 3, such that the stator 3 does not contact the working fluid. Thus, the electrical conductively of the working fluid is not limited in this embodiment. Furthermore, in this embodiment, the backstop 15 can be contiguous to an inner periphery Q of the communication hole 111. Namely, the backstop 15 can be a protrusion extending upwards from the inner periphery Q of the communication hole 111, such that the backstop 15 also provides a flow guiding function to permit the working fluid passing through the communication hole 111 to flow towards the inlet opening 44 of the impeller 4 under the guidance of the backstop 15. Thus, the working fluid flowing towards the outer periphery of the impeller 4 is limited.

Figure 8:
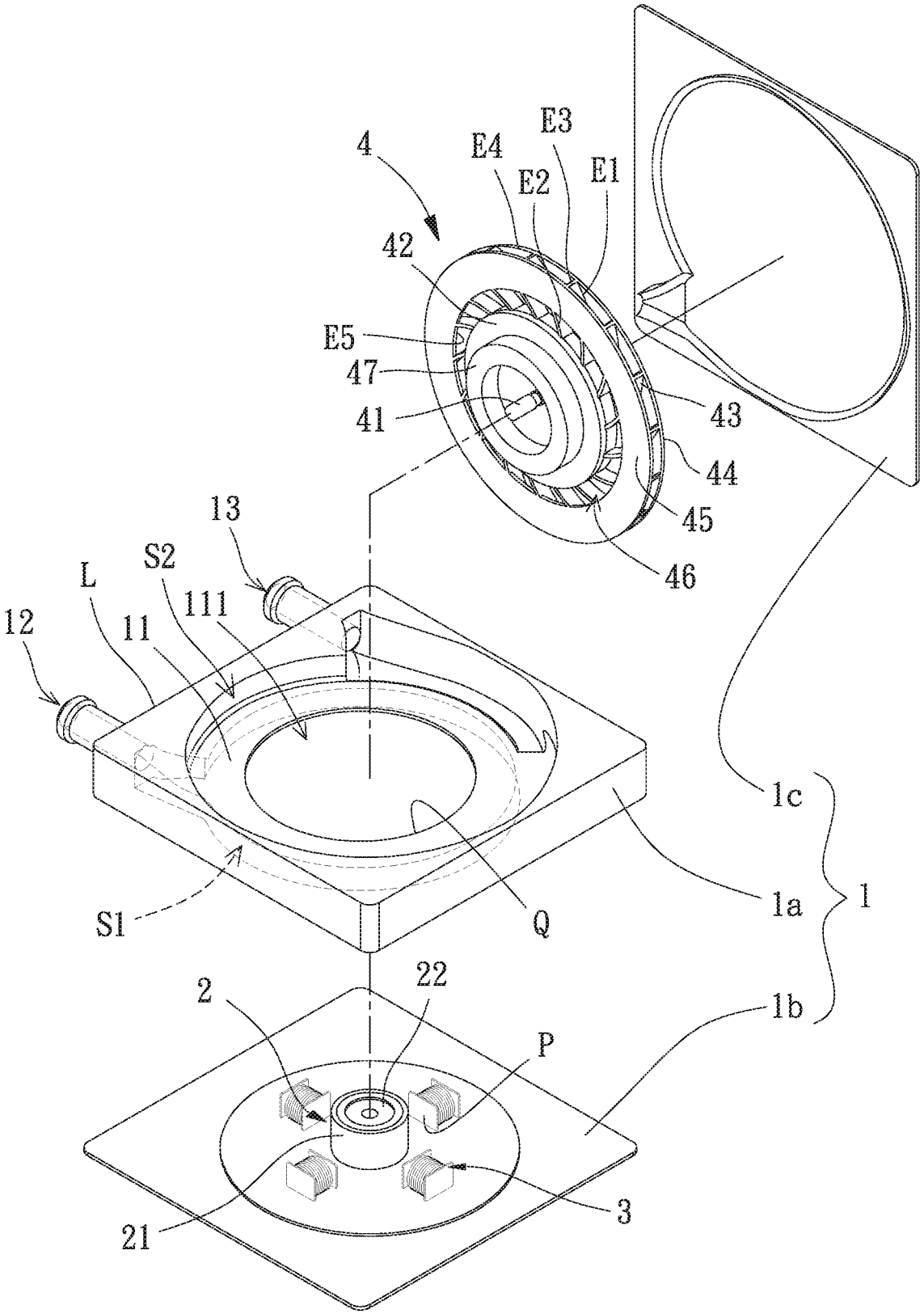
FIG. 8 is an exploded, perspective view of a slim pump of a fourth embodiment according to the present invention.
Figure 9:
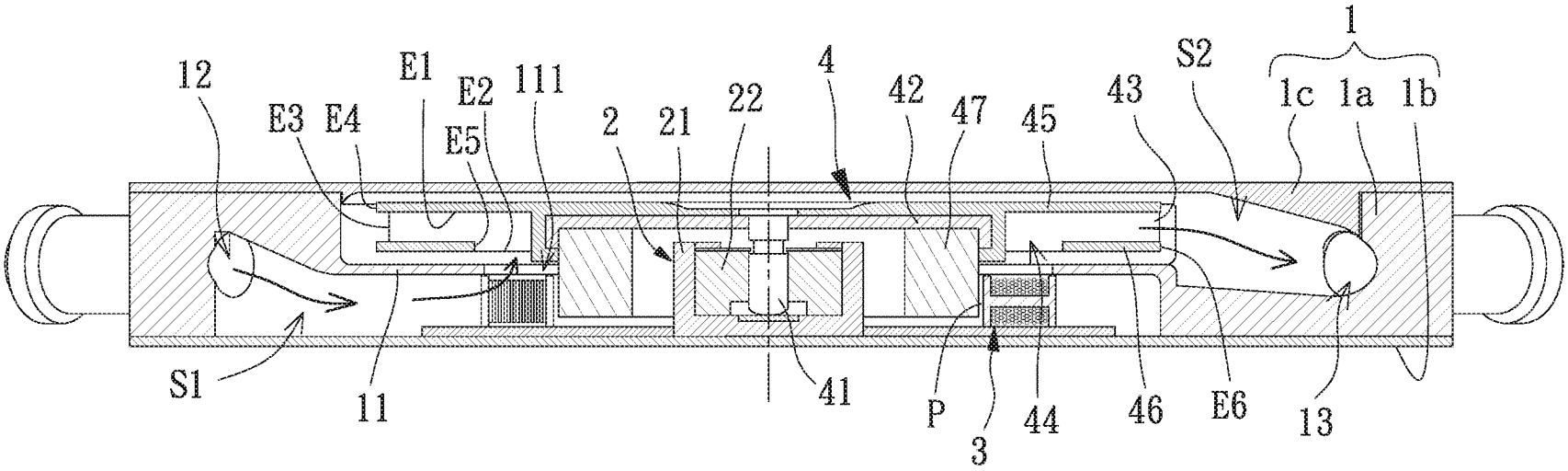
FIG. 9 is a cross sectional view of the slim pump of the fourth embodiment according to the present invention.

With reference to FIGS. 8 and 9, which show a slim pump of a fourth embodiment according to the present invention, this embodiment utilizes an inductive stator 3 including poles P having coils which are radially wound, and each two adjacent poles P have a passageway therebetween to permit passage of the working fluid. The working fluid can be a gas or an electrically nonconductive fluid. In an alternative embodiment, the stator 3 can also be enveloped by a waterproof glue, such that the working fluid will not cause a short circuit of the stator 3 even if the stator 3 is disposed in the first chamber S1. Therefore, the electrical conductivity of the working fluid is not limited. Namely, gases and electrically conductive or nonconductive fluids can all be used.

Figure 10:
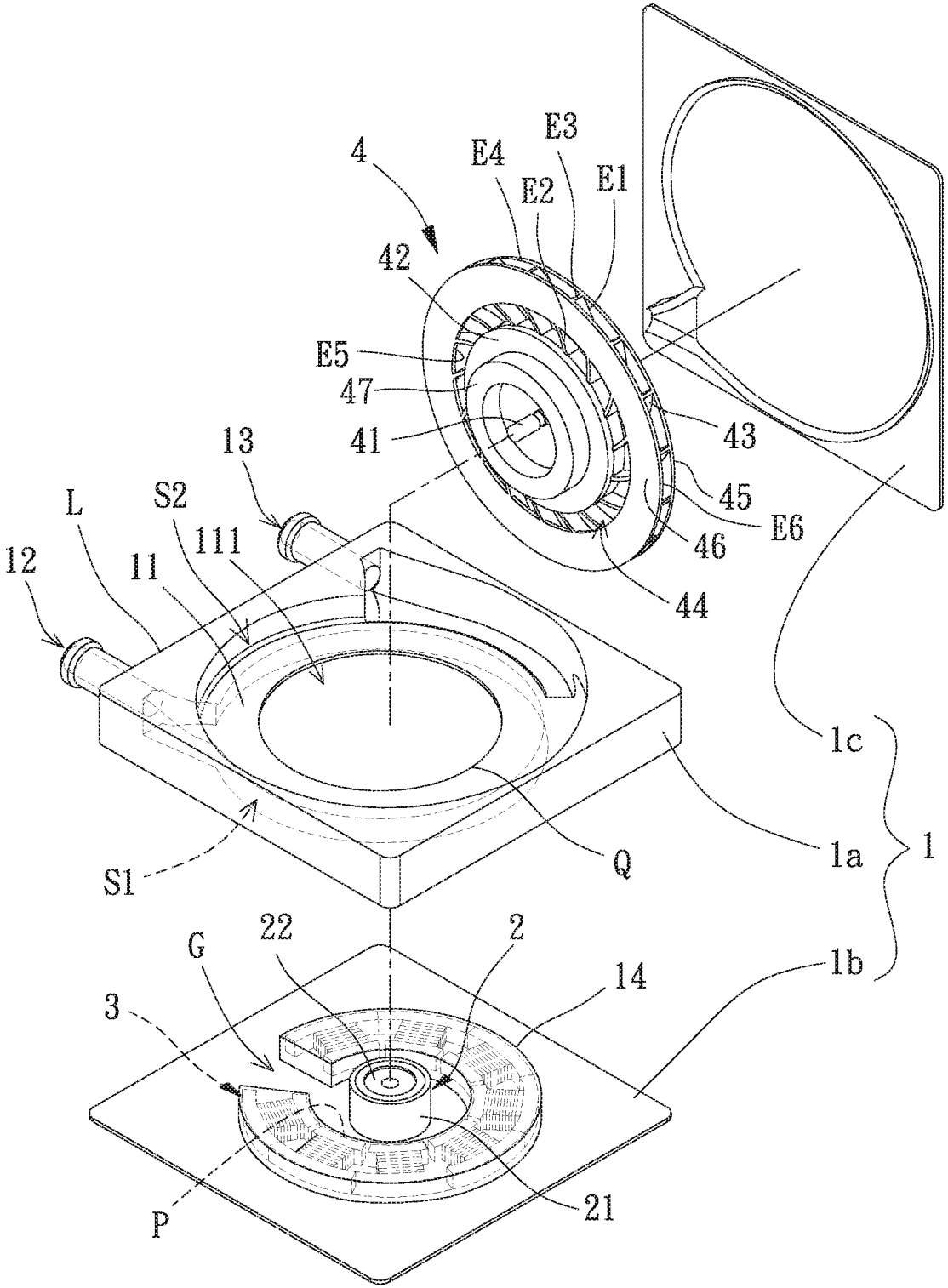
FIG. 10 is an exploded, perspective view of a slim pump of a fifth embodiment according to the present invention.
Figure 11:
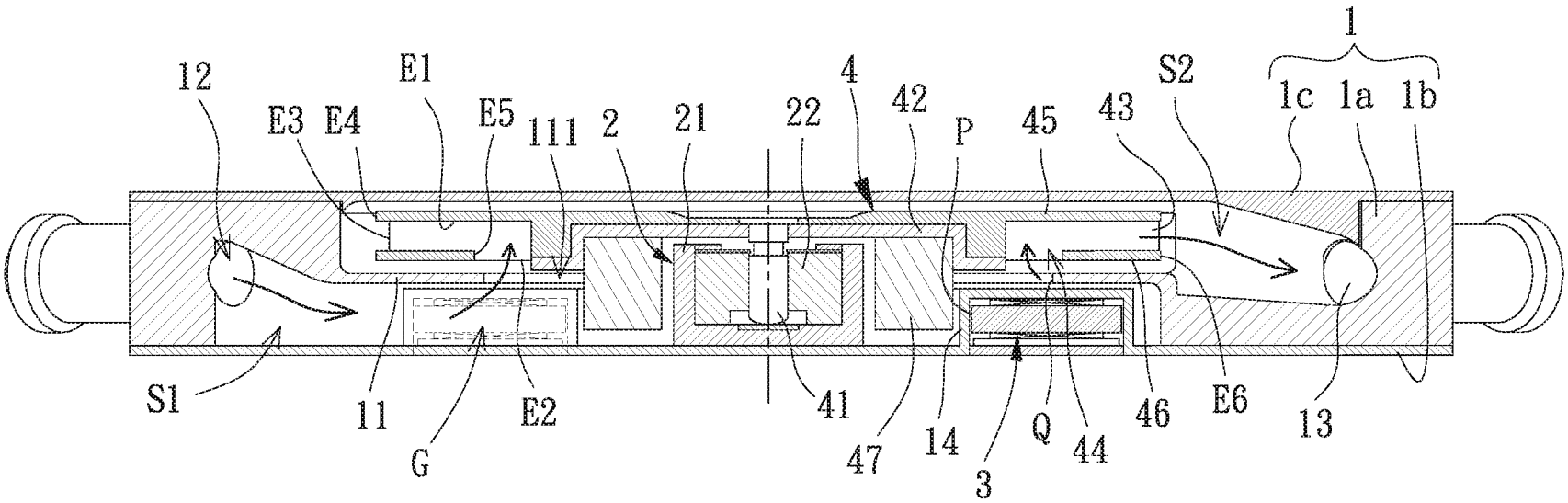
FIG. 11 is a cross sectional view of the slim pump of the fifth embodiment according to the present invention.

With reference to FIGS. 10 and 11, which show a slim pump of a fifth embodiment according to the present invention, the frame 1 of this embodiment includes the above-mentioned elevated portion 14, and the stator 3 and the magnetic member 47 of the impeller 4 have a radial air gap therebetween. To increase the flowing smoothness and the flow volume, the elevated portion 14 can be a C-shaped annulus with a gap G in the first chamber S1. The gap G provides a passageway through which the working fluid flows. Accordingly, one of the poles P of the stator 3 can be omitted to permit insertion into the elevated portion 14, and a portion of the stator 3 where the pole P is omitted is aligned with the gap G. Thus, the resistance to the working fluid at the gap G can be significantly reduced, such that the working fluid can flow towards the second chamber S2 more smoothly. The gap G preferably faces the flow inlet 12, such that the working fluid can pass through the gap G to flow upwards as soon as flowing into the first chamber S1, thereby reducing the energy loss resulting from impact of the working fluid to the elevated portion 14. In an alternative embodiment without the elevated portion 14, one of the poles P of the stator 3 can be omitted to form a slot T with similar alignment and providing the same effect as the gap G of the elevated portion 14.

Figure 12:
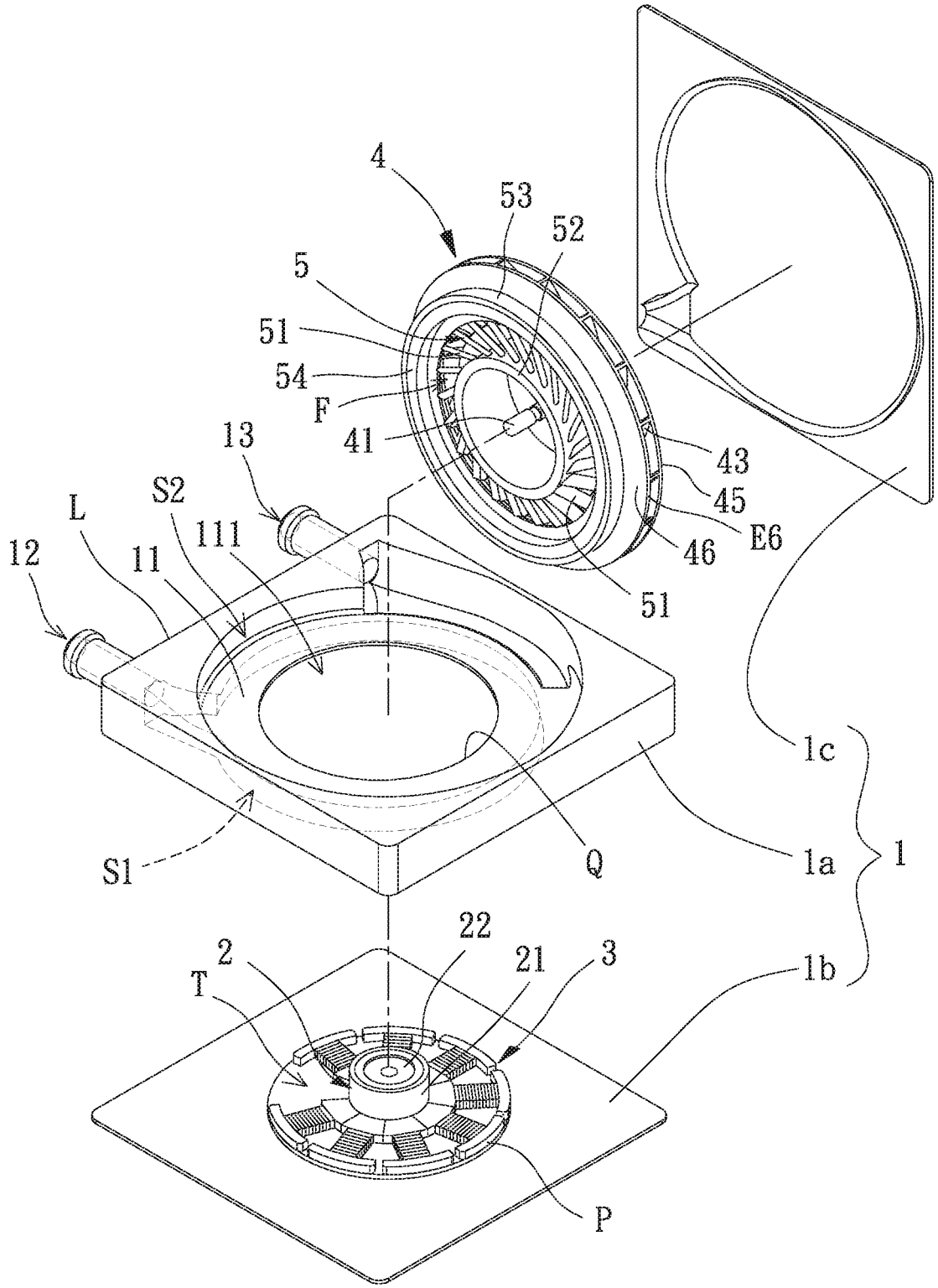
FIG. 12 is an exploded, perspective view of a slim pump of a sixth embodiment according to the present invention.
Figure 13:
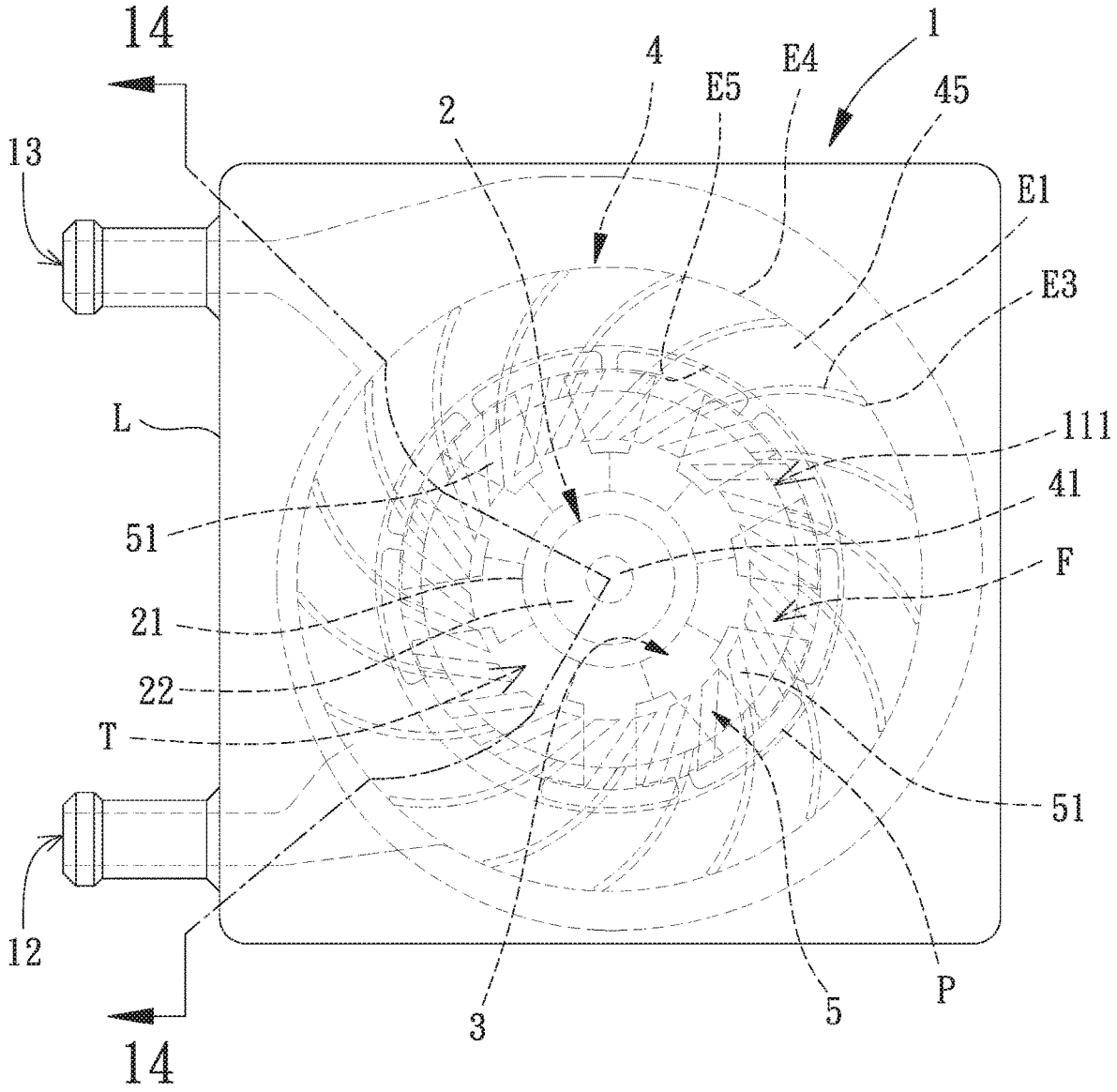
FIG. 13 is a top view of the slim pump of the sixth embodiment according to the present invention.
Figure 14:
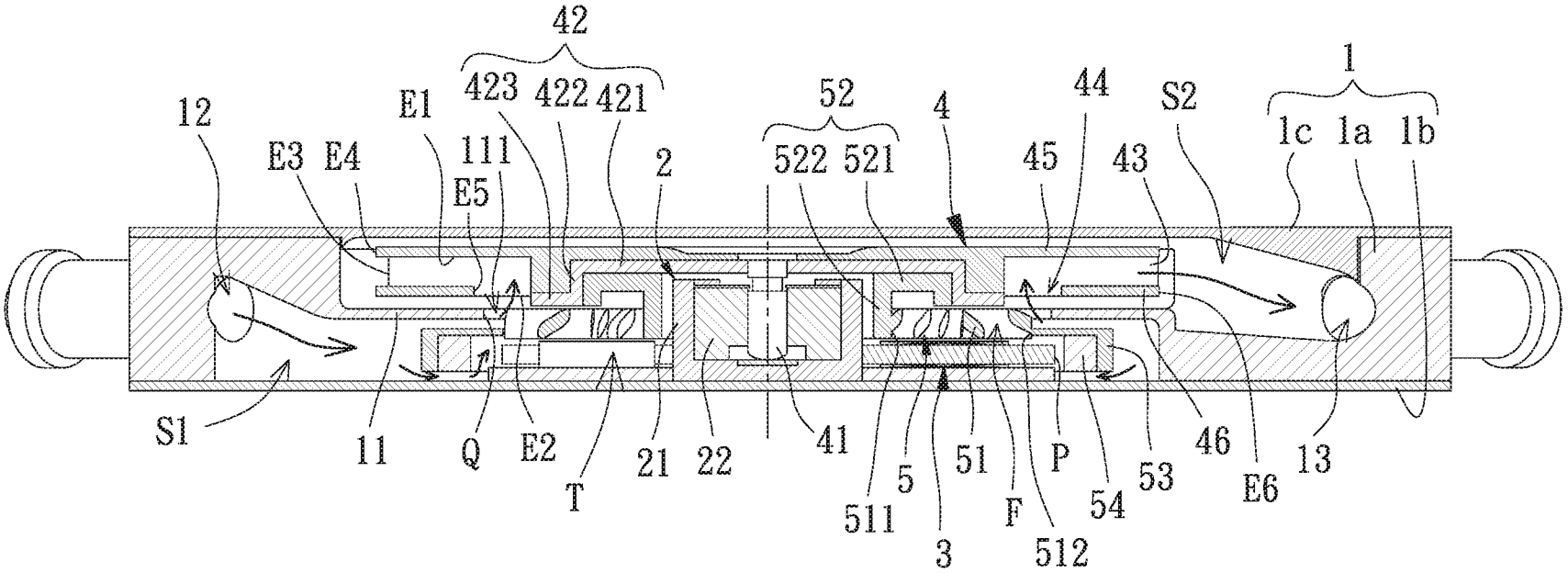
FIG. 14 is a cross sectional view taken along section line 14-14 of FIG. 13.

With reference to FIGS. 12-14, which show a slim pump of a sixth embodiment according to the present invention, the slim pump of this embodiment further includes a guiding unit 5 coupled to the impeller 4 to rotate therewith. The guiding unit 5 can include a plurality auxiliary flow guiding members 51 disposed around the shaft-coupling portion 2. Each two adjacent auxiliary flow guiding members 51 form a passageway F therebetween. When the guiding unit 5 rotates together with the impeller 4, the plurality of auxiliary flow guiding members 51 assists in guiding the working fluid to flow from the first chamber S1 into the second chamber S2 and increases the pressure of the working fluid flowing into the impeller 4. The number of the plurality of auxiliary flow guiding members 51 can be greater than the number of the plurality of blades 43. Thus, the plurality of auxiliary flow guiding members 51 increases the pressure of guiding the working fluid flowing upwards into the second chamber S2. The number of the plurality of blades 43 is lesser to increase the smoothness of discharging of the working fluid.

More specifically, the hub 42 of this embodiment includes a central disc 421. An outer periphery of the central disc 421 is connected to a radial extension portion 423 by an axial extension portion 422. Each of the plurality of auxiliary flow guiding members 51 includes an inner edge 511 and an outer edge 512 radially aligned with the inner edge 511. The guiding unit 5 can be connected to the inner edges 511 of the plurality of auxiliary flow guiding members 51 with a disc seat 52. Furthermore, the disc seat 52 can be connected to the hub 42. In this embodiment, the disc seat 52 can include a coupling portion 521 and a sleeve 522 connected to the coupling portion 521. The coupling portion 521 can be connected to the central disc 421 and the axial extension portion 422 of the hub 42. The sleeve 522 is located around the shaft-coupling portion 2 and can be connected to the inner edge 511 of each of the plurality of auxiliary flow guiding members 51. Thus, the plurality of auxiliary flow guiding members 51 can be located below the plurality of blades 43. Furthermore, the inlet opening 44 can be located between the plurality of blades 43 and the plurality of auxiliary flow guiding members 51. The plurality of auxiliary flow guiding members 51 can be substantially located at an upper portion of the first chamber S1 and can be located within the diametric extent of the communication hole 111, thereby providing a better flow guiding effect.

The plurality of auxiliary flow guiding members 51 can extend radially beyond the disc seat 52 and the hub 42, such that the outer edges 512 of the plurality of auxiliary flow guiding members 51 can be axially aligned with the inlet opening 44. The guiding unit 5 can further include an extension seat 53 connected to the outer edges 512 of the plurality of auxiliary flow guiding members 51. A magnetic member 54 can be connected to the extension seat 53 and can be axially or radially aligned with the stator 3. In this embodiment, the stator 3 can be disposed between the shaft-coupling portion 2 and the magnetic member 54, and the magnetic member 54 can be radially aligned with the stator 3. In this embodiment, one of the poles P of the stator 3 can also be lacked to form the above-mentioned slot T. Furthermore, when the stator 3 is used with a working fluid with a higher electrical conductivity, the stator 3 can be enveloped by a waterproof glue to prevent short circuit caused by the working fluid.

With reference to FIG. 14, according to the above-mentioned structure, the working fluid flowing from the outside into the first chamber S1 can pass through the gap between the extension seat 53 and the partitioning board 11, the slot T of the poles P of the stator 3, the gaps between the poles P of the stator 3, the air gap between the stator 3 and the magnetic member 54, and the passageways F between the plurality of auxiliary flow guiding members 51. Then, the working fluid flows through the communication hole 111 into the second chamber S2 and passes through the inlet opening 44 into the spaces between the plurality of blades 43. Next, the working fluid is guided by the plurality of blades 43 to exit the second chamber S2. The working fluid passing through the passageways F between the plurality of auxiliary flow guiding members 51 can be in a substantially axial flow type flow-guiding pattern with axial input and axial output.

Figure 15:
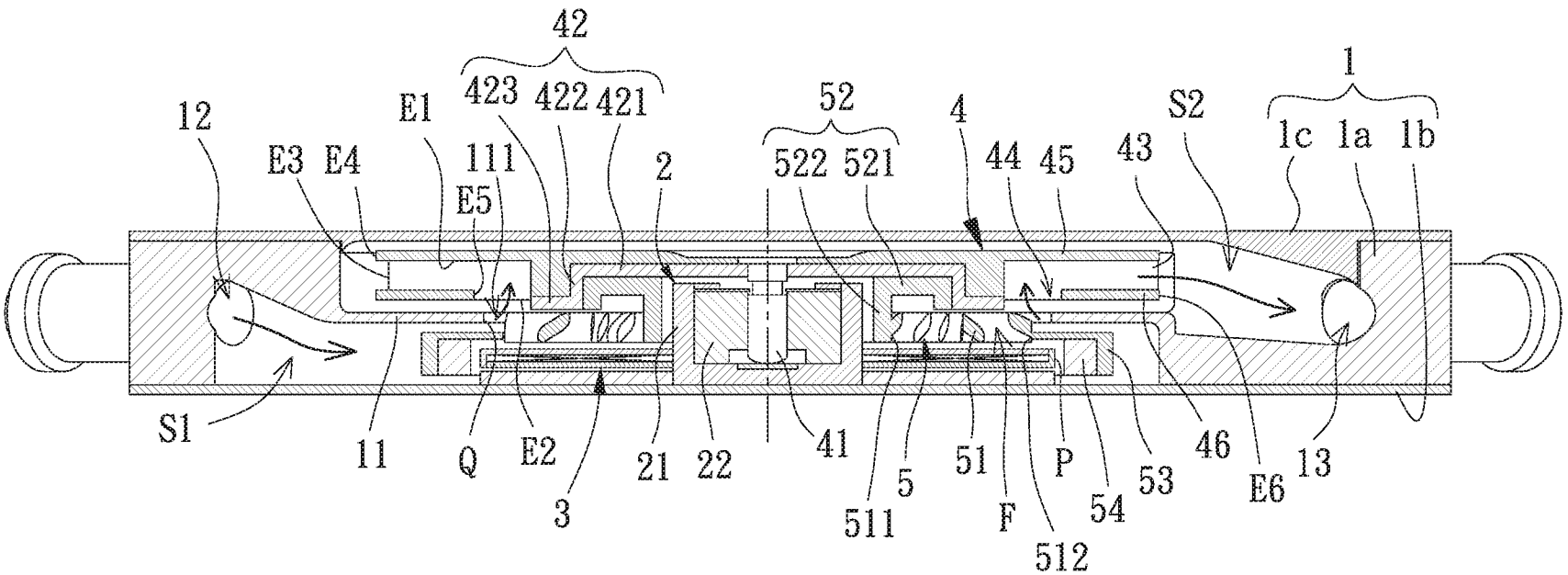
FIG. 15 is a cross sectional view of a slim pump of another embodiment according to the present invention.

Furthermore, the stator 3 of this embodiment can include, but not limited to, a plurality of annularly disposed poles P formed by stacking silicon steel plates, which can be radially wound by coils. In another embodiment, such as the embodiment shown in FIG. 15, the stator 3 uses upper and lower magnetically conductive pieces formed by pressing and includes coils axially wound around the shaft tube 21, which serves as the center. Other forms of stator 3 can also be used. Furthermore, the stator 3 and the magnetic member 54 can be aligned axially or radially according to needs and is not limited in the present invention. Furthermore, the slot T can be optionally provided according to needs and is not limited in the present invention, either.

Figure 16:
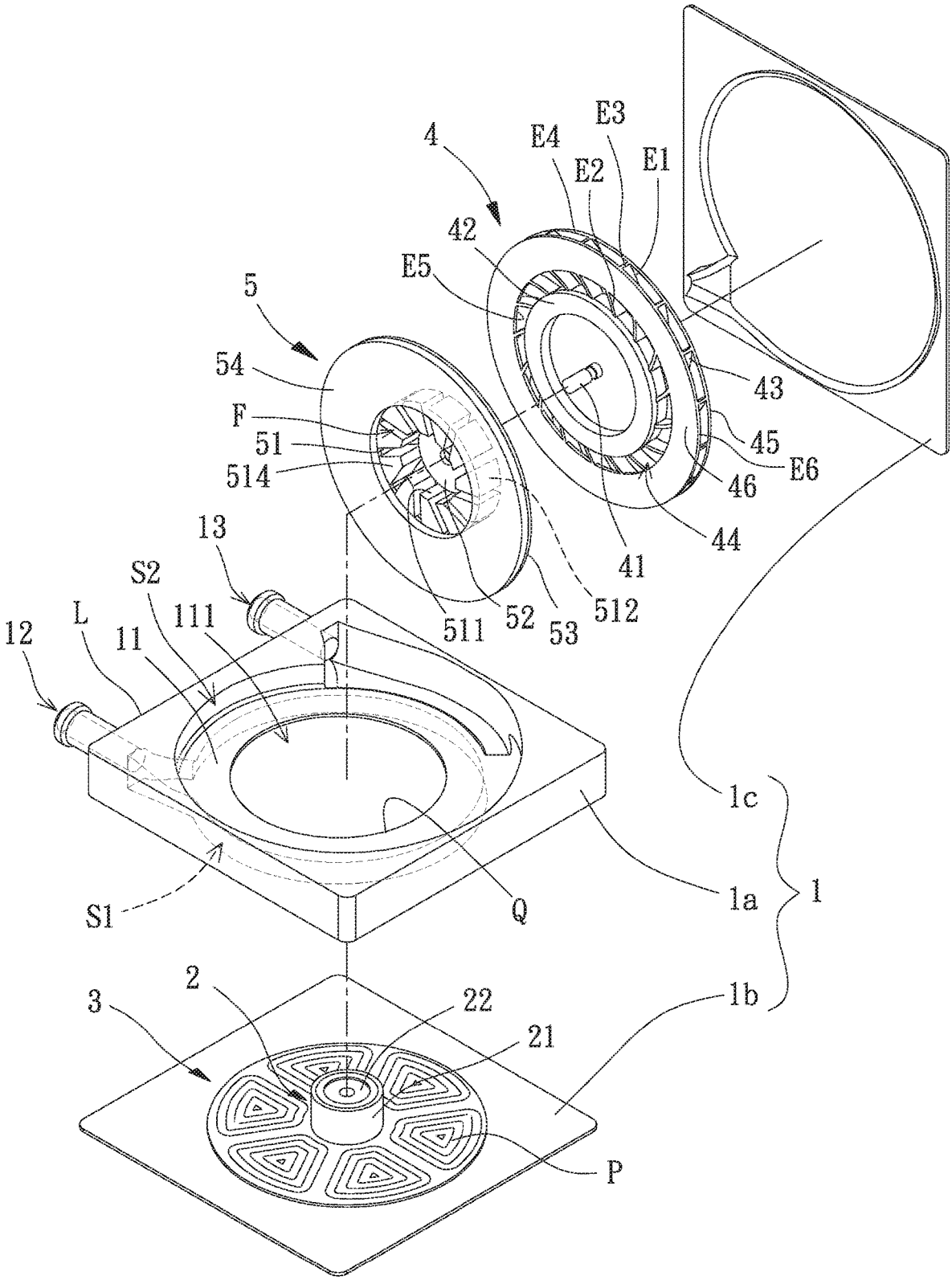
FIG. 16 is an exploded, perspective view of a slim pump of a seventh embodiment according to the present invention.
Figure 17:
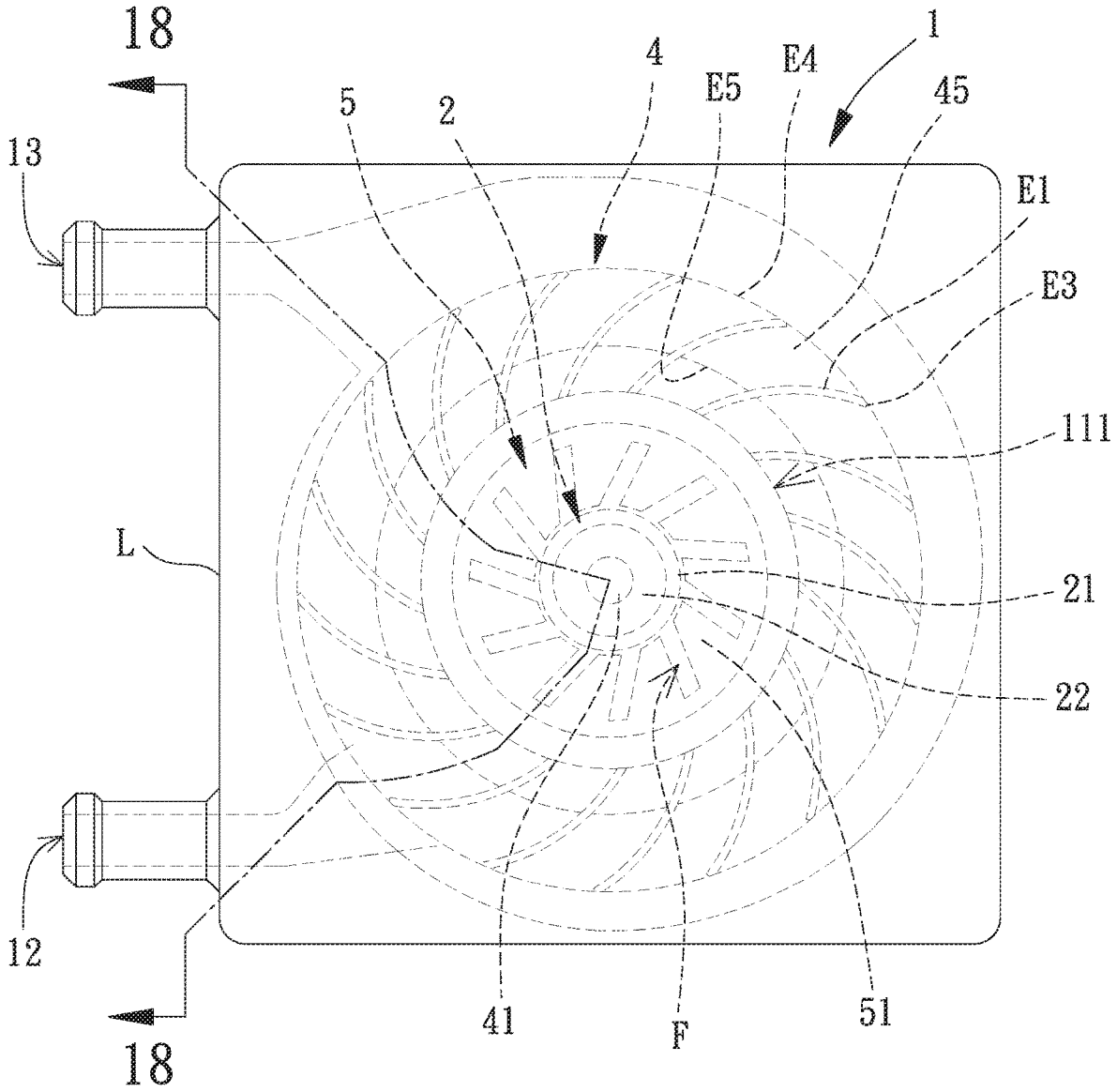
FIG. 17 is a top view of the slim pump of the seventh embodiment according to the present invention.
Figure 18:
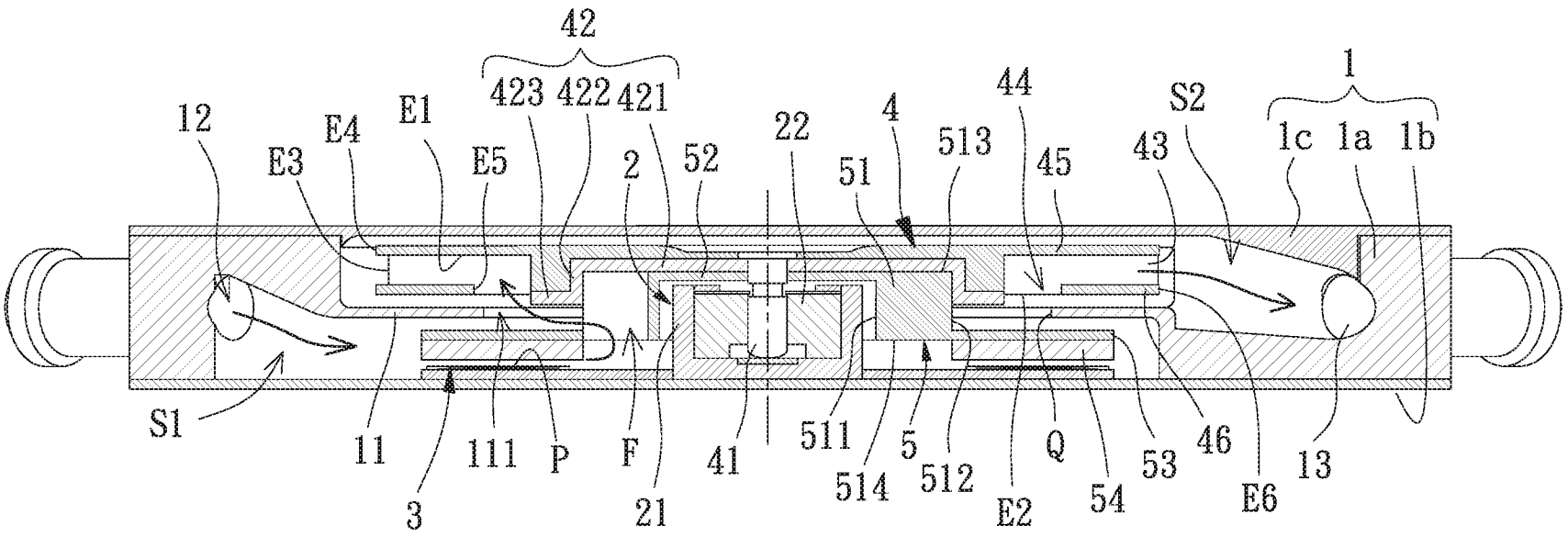
FIG. 18 is a cross sectional view taken along section line 18-18 of FIG. 17.

With reference to FIGS. 16-18, which show a slim pump of a seventh embodiment according to the present invention, this embodiment includes a stator 3 with printed coils. Furthermore, the outline of the guiding unit 5 of this embodiment is slightly different from that of the above-mentioned sixth embodiment.

Figure 19:
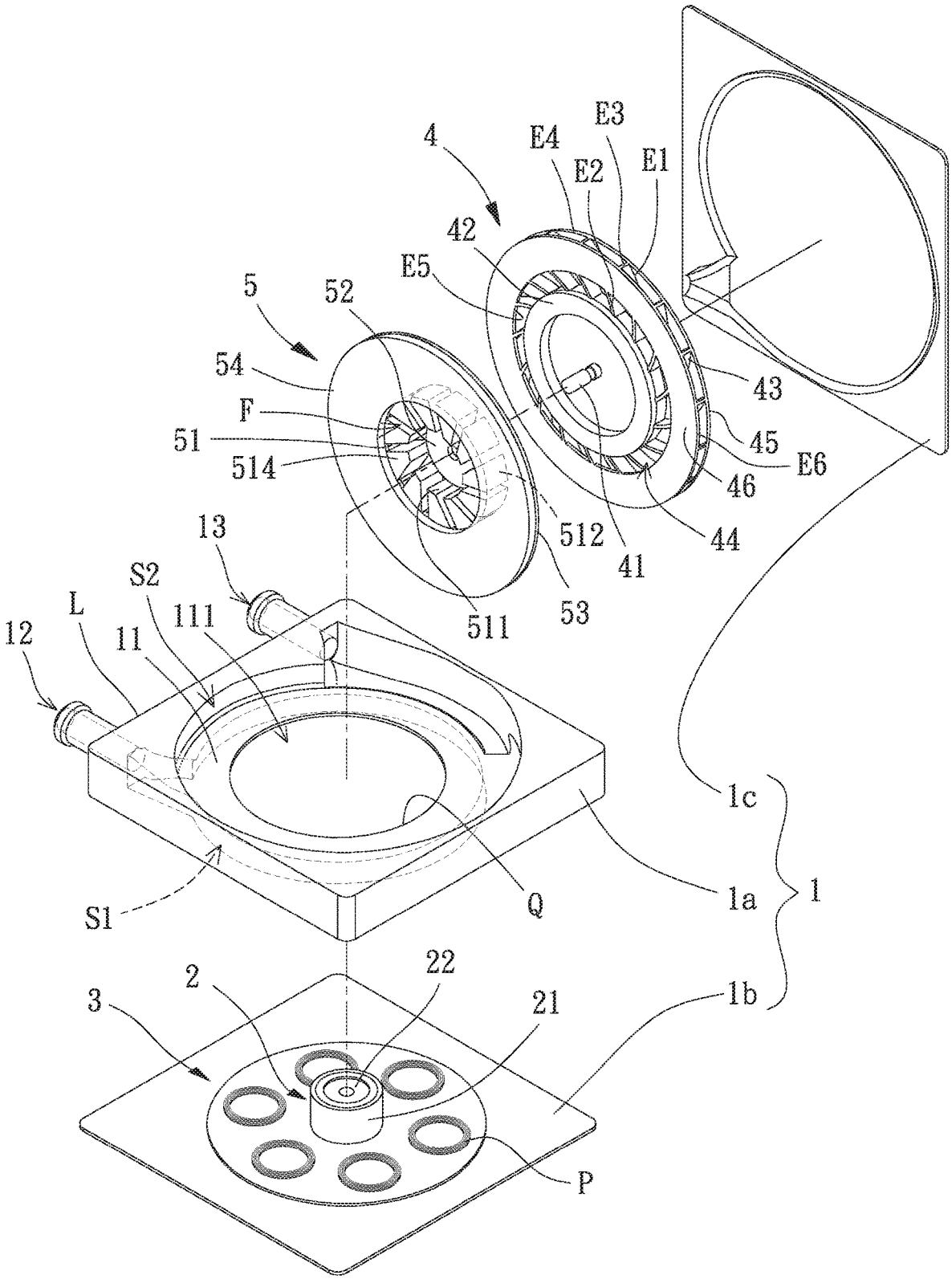
FIG. 19 is an exploded, perspective view of a slim pump of another embodiment according to the present invention.

Specifically, each of the plurality of auxiliary flow guiding members 51 of this embodiment includes an inner edge 511, an outer edge 512 radially aligned with the inner edge 511, a top portion 513, and a bottom portion 514 axially aligned with the top portion 513. The disc seat 52 is connected to the inner edges 511 of the plurality of auxiliary flow guiding members 51. Furthermore, the disc seat 52 can be connected to the central disc 421 of the hub 42 and can be extended through by the shaft 41. The top portions 513 of the plurality of auxiliary flow guiding members 51 can be connected to the central disc 421 and the axial extension portion 422 of the hub 42. The bottom portions 514 of the plurality of auxiliary flow guiding members 51 can extend beyond the radial extension portion 423 of the hub 42 into the first chamber S1, and the plurality of auxiliary flow guiding members 51 can be located within the diametric extent of the communication hole 111. The extension seat 53 is connected to the outer edges 512 of the plurality of auxiliary flow guiding members 51 adjacent to the bottom portions 514. The extension seat 53 can be located in the first chamber S1 and can be connected to the magnetic member 54, and the magnetic member 54 can be axially aligned with the stator 3. In another embodiment, the stator 3 can be corelessly wound, as shown in FIG. 19, so as to axially align with the magnetic member 54. Alternatively, the stator 3 of the type shown in FIGS. 14 and 15 can be used, and the type of the extension seat 53 of this embodiment can be varied to radially align the stator 3 with the magnetic member 54.

With reference to FIG. 18, according to the above-mentioned structure, the working fluid flowing from the outside into the first chamber S1 can pass through the gap between the extension seat 53 and the partitioning board 11, the air gap between the stator 3 and the magnetic member 54, and the passageways F between the plurality of auxiliary flow guiding members 51. Then, the working fluid flows through the communication hole 111 into the second chamber S2 and passes through the inlet opening 44 into the spaces between the plurality of blades 43. Next, the working fluid is guided by the plurality of blades 43 to exit the second chamber S2. The working fluid passing through the passageways F between the plurality of auxiliary flow guiding members 51 can be in a substantially centrifugal type flow-guiding pattern with axial input and lateral output.

In view of the foregoing, due to the configuration of the partitioning board and the impeller in the slim pump according to the present invention, the working fluid guided from the outside can fully utilize the remaining space in the first chamber for flow guiding purposes. Furthermore, when flowing into the second chamber, the working fluid can pass through the inlet opening and is, thus, guided into the spaces between the plurality of blades and is then smoothly discharged under guidance of the impeller. Thus, the slim pump according to the present invention can fully utilize the space in the frame for guiding the working fluid and can assure the working fluid to flow smoothly under guidance, reducing mutual interference between the incoming flow and the outgoing flow. Thus, an expected flow volume and an expected lift can be achieved even under a condition of a limited dimension of the slim pump.

It is worth mentioning that the type of the stator disclosed in each of the above embodiments is not limited to be used with the frame or impeller illustrated in the corresponding figures. Namely, the components in the embodiments can be varied and interchanged according to needs, which can be appreciated by one having ordinary skill in the art and should not be limited by the forms illustrated in the figures.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A pump comprising:

a frame including an interior separated by a partitioning board into a first chamber and a second chamber, wherein a flow inlet intercommunicates with the first chamber and a flow outlet intercommunicates with the second chamber, and wherein the first chamber is intercommunicated with the second chamber via a communication hole of the partitioning board;

a shaft-coupling portion located in the frame;

a stator disposed around the shaft-coupling portion and located within an axial extent of the first chamber, wherein the stator is axially aligned with the communication hole; and an impeller including a plurality of blades and an inlet opening located in the second chamber, wherein the inlet opening faces and axially aligns with the communication hole in an axial direction, wherein the communication hole is located between the impeller and the stator in the axial direction.

2. The pump as claimed in claim 1, wherein the impeller includes a shaft rotatably coupled to the shaft-coupling portion, wherein the shaft is connected to a hub, wherein a top disc is connected to blade top edges of the plurality of blades and the hub, wherein an annular member is connected to blade bottom edges of the plurality of blades, and wherein the inlet opening is formed between an annular inner edge of the annular member and the hub.

3. The pump as claimed in claim 2, wherein the communication hole is axially aligned within a diametric extent of the annular inner edge of the annular member.

4. The pump as claimed in claim 2, wherein the top disc includes a disc outer edge, wherein the annular member has an annular outer edge, and wherein the disc outer edge of the top disc and the annular outer edge of the annular member are flush with blade outer edges of the plurality of blades.

5. The pump as claimed in claim 2, wherein the impeller includes a magnetic member coupled to the hub and disposed around the shaft-coupling portion, and wherein the magnetic member is radially or axially aligned with the stator.

6. The pump as claimed in claim 2, wherein the frame includes a backstop disposed around the communication hole, and wherein the backstop is located between the partitioning board and the annular member.

7. The pump as claimed in claim 1, wherein the first chamber is axially adjacent to the second chamber, and wherein the flow inlet and the flow outlet are on a radial side of the frame.

8. The pump as claimed in claim 1, wherein the stator is located in the first chamber, and wherein the impeller is configured to drive an electrically nonconductive fluid to flow.

9. The pump as claimed in claim 1, wherein the frame includes a body on which the partitioning board is disposed, a bottom board connected to the body, and a lid connected to the body, wherein the first chamber is formed between the partitioning board and the bottom board, and wherein the second chamber is formed between the lid and the partitioning board.

10. The pump as claimed in claim 9, wherein the bottom board includes an elevated portion located within the axial extent of the first chamber, and wherein the stator is received in the elevated portion and located outside of the frame.

11. The pump as claimed in claim 6, wherein the backstop is contiguous to an inner periphery of the communication hole.

12. A slim pump comprising:

a frame including an interior separated by a partitioning board into a first chamber and a second chamber, wherein a flow inlet intercommunicates with the first chamber and a flow outlet intercommunicates with the second chamber, and wherein the first chamber is intercommunicated with the second chamber via a communication hole of the partitioning board;

a shaft-coupling portion located in the frame;

a stator disposed around the shaft-coupling portion and located within an axial extent of the first chamber, wherein the stator is axially aligned with the communication hole;

an impeller including a plurality of blades and an inlet opening located in the second chamber, wherein the inlet opening faces and axially aligns with the communication hole, wherein the impeller includes a shaft rotatably coupled to the shaft-coupling portion, wherein the shaft is connected to a hub, wherein a top disc is connected to blade top edges of the plurality of blades and the hub, wherein an annular member is connected to blade bottom edges of the plurality of blades, and wherein the inlet opening is formed between an annular inner edge of the annular member and the hub; and a guiding unit coupled to the impeller to rotate therewith, wherein the guiding unit includes a plurality of auxiliary flow guiding members disposed around the shaft-coupling portion, wherein each two adjacent auxiliary flow guiding members form a passageway therebetween, and wherein the plurality of auxiliary flow guiding members is located within a diametric extent of the communication hole.

13. The pump as claimed in claim 12, wherein the guiding unit includes a disc seat connected to the hub and an inner edge of each of the plurality of auxiliary flow guiding members.

14. The pump as claimed in claim 13, wherein the disc seat includes a coupling portion and a sleeve connected to the coupling portion, wherein the coupling portion is connected to the hub, wherein the sleeve is located around the shaft-coupling portion, wherein the inner edges of the plurality of auxiliary flow guiding members are connected to the sleeve, and wherein the inlet opening is located between the plurality of blades and the plurality of auxiliary flow guiding members.

15. The pump as claimed in claim 14, wherein the plurality of auxiliary flow guiding members extends radially beyond the hub, and wherein an outer edge of each of the plurality of auxiliary flow guiding members is axially aligned with the inlet opening.

16. The pump as claimed in claim 12, wherein a number of the plurality of auxiliary flow guiding members is greater than a number of the plurality of blades.

17. The pump as claimed in claim 12, wherein the shaft is coupled to a central disc of the hub, wherein each of the plurality of auxiliary flow guiding members has a top portion coupled to the central disc of the hub, and wherein each of the plurality of auxiliary flow guiding members has a bottom portion extending into the first chamber.

18. The pump as claimed in claim 12, wherein the guiding unit includes an extension seat connected to an outer edge of each of the plurality of auxiliary flow guiding members, and wherein a magnetic member is coupled to the extension seat and is axially or radially aligned with the stator.

19. A pump comprising:

a frame including an interior separated by a partitioning board into a first chamber and a second chamber, wherein a flow inlet intercommunicates with the first chamber and a flow outlet intercommunicates with the second chamber, and wherein the first chamber is intercommunicated with the second chamber via a communication hole of the partitioning board;

a shaft-coupling portion located in the frame;

a stator disposed around the shaft-coupling portion and located within an axial extent of the first chamber, wherein the stator is axially aligned with the communication hole; and an impeller including a plurality of blades and an inlet opening located in the second chamber, wherein the inlet opening faces and axially aligns with the communication hole, wherein the stator is located in the first chamber, wherein the impeller is configured to drive an electrically nonconductive fluid to flow, and wherein one of poles of the stator is omitted to form a slot through which a working fluid flows.

20. The pump as claimed in claim 19, wherein the slot faces the flow inlet.

21. A pump comprising:

a frame including an interior separated by a partitioning board into a first chamber and a second chamber, wherein a flow inlet intercommunicates with the first chamber and a flow outlet intercommunicates with the second chamber, and wherein the first chamber is intercommunicated with the second chamber via a communication hole of the partitioning board;

a shaft-coupling portion located in the frame;

a stator disposed around the shaft-coupling portion and located within an axial extent of the first chamber, wherein the stator is axially aligned with the communication hole; and an impeller including a plurality of blades and an inlet opening located in the second chamber, wherein the inlet opening faces and axially aligns with the communication hole, wherein the frame includes a body on which the partitioning board is disposed, a bottom board connected to the body, and a lid connected to the body, wherein the first chamber is formed between the partitioning board and the bottom board, wherein the second chamber is formed between the lid and the partitioning board, wherein the bottom board includes an elevated portion located within the axial extent of the first chamber, wherein the stator is received in the elevated portion and located outside of the frame, wherein the elevated portion is a C-shaped annulus with a gap in the first chamber to permit flow of a working fluid, wherein one of poles of the stator is omitted, and wherein a portion of the stator where the pole is omitted is aligned with the gap.

22. The pump as claimed in claim 21, wherein the gap faces the flow inlet.

* * * * *